US008994766B2

(12) United States Patent
Kako et al.

(10) Patent No.: US 8,994,766 B2
(45) Date of Patent: Mar. 31, 2015

(54) PRINTER

(71) Applicant: Brother Kogyo Kabushiki Kaisha, Nagoya-shi, Aichi-ken (JP)

(72) Inventors: Keigo Kako, Nagoya (JP); Tomoki Miyashita, Nagoya (JP); Yoshitsugu Tomomatsu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/341,158

(22) Filed: Jul. 25, 2014

(65) Prior Publication Data

US 2015/0029287 A1 Jan. 29, 2015

(30) Foreign Application Priority Data

Jul. 25, 2013 (JP) ..... 2013-154827

(51) Int. Cl.
*B41J 2/00* (2006.01)
*B41J 2/355* (2006.01)

(52) U.S. Cl.
CPC ..... *B41J 2/3556* (2013.01)
USPC ..... 347/188

(58) Field of Classification Search
USPC ..... 347/180, 188, 190, 196, 211
See application file for complete search history.

(56) References Cited

U.S. PATENT DOCUMENTS 5,038,154 A * 8/1991 Yamamoto et al. ..... 347/180
5,066,960 A * 11/1991 Deguchi et al. ..... 347/180
5,105,348 A * 4/1992 Shimonaga ..... 347/180
5,157,411 A * 10/1992 Takekoshi et al. ..... 347/211
7,369,145 B2 * 5/2008 Busch et al. ..... 347/188
8,610,750 B2 * 12/2013 Liu et al. ..... 347/188

FOREIGN PATENT DOCUMENTS

JP 2013-018141 A 1/2013

* cited by examiner

*Primary Examiner* — Kristal Feggins
(74) *Attorney, Agent, or Firm* — Banner & Witcoff, Ltd.

(57) ABSTRACT

The disclosure discloses a printer including a controller. The controller executes a first control, a second control and a switching control. In the first control, it is achieved that a first coordinated state wherein a pulse/dot ratio when a pulse motor rotates at a first rotation speed is set to a first ratio. In the second control, it is achieved that a second coordinated state wherein the pulse/dot ratio when the pulse motor rotates at a second rotation speed is set to a second ratio that is smaller than the first ratio. In the switching control, the pulse/dot ratio is gradually decreased from the first ratio to the second ratio when the first coordinated state is switched to the second coordinated state, and is gradually increased from the second ratio to the first ratio when the second coordinated state is switched to the first coordinated state.

3 Claims, 14 Drawing Sheets

COMPARISON EXAMPLE

EMBODIMENT

EXAMPLE: GIVEN Va = 30, Vb = 20, ΔV = 2.5, AND D = 15, THEN:
Vb' = 20 - 3(27.5 - 20) / 15
= 20 - 0.15
= 19.85

IN THIS MANNER, Vb = 20 IS REVISED DOWNWARD TO Vb' = 19.85, THEREBY PREVENTING AN INCREASE IN THE TOTAL OPERATION TIME TO THE EXTENT POSSIBLE, RESULTING IN A PRINT TIME THAT IS SUBSTANTIALLY CONSTANT REGARDLESS OF WHETHER OR NOT THERE IS PRINT LENGTH CORRECTION.

PRINTER

CROSS-REFERENCE TO RELATED APPLICATION

The present application claims priority from Japanese Patent Application No. 2013-154827, which was filed on Jul. 25, 2013, the disclosure of which is incorporated herein by reference in its entirety.

BACKGROUND

1. Field

The present disclosure relates to a printer that performs desired printing on a print-receiving medium.

2. Description of the Related Art

There are known printers that perform printing utilizing a driving force of a pulse motor. In this printer, feeding means (a roller driving motor) feeds a print-receiving medium (cover film) by a driving force of a pulse motor (roller driving motor), and a thermal head performs the desired printing on the print-receiving medium thus fed. The pulse motor rotates at a predetermined angle by applying a single pulse signal (switching the excitation phase to the next state), and the rotation speed is controlled by shortening and lengthening the interval at which the pulse is applied. The thermal head comprises a plurality of heating elements arranged in a direction orthogonal to the transport direction. This plurality of heating elements performs printing by forming dots on the respective printing lines of the print-receiving medium. Specifically, in response to the print-receiving medium being fed by the feeding means and the printing lines of the print-receiving medium sequentially passing the positions of the heating elements, the conduction mode of the heating elements is sequentially switched on a per line print data (section of print data divided into one of the printing line units) basis. With this arrangement, it is possible for the thermal head to perform printing at a printing speed that matches the feeding speed of the print-receiving medium by the feeding means.

In the printer that uses the pulse motor, the coordination mode in a case where feeding and printing are performed in coordination as described above may be switched between one coordinated state wherein the pulse motor rotates at a relatively fast rotation speed and another coordinated state wherein the pulse motor rotates at a relatively slow rotation speed, executed to correct the print length so that it is shorter. At such a time, when the conduction of the plurality of heating elements and the driving of the pulse motor are controlled in coordination and the mode is switched from the one coordinated state to the other coordinated state or conversely from the other coordinated state to the one coordinated state, the possibility exists that the input of the pulse signal and the switching of the excitation phase will become mismatched if there is a large difference in the rotation speeds of the pulse motor, causing difficulties in smooth motor operation.

SUMMARY

It is therefore an object of the present disclosure to provide a printer capable of maintaining smooth motor operation even in a case where two coordination modes with different rotation speeds of the pulse motor are switched when feeding and printing are controlled in coordination.

In order to achieve the above-described object, according to the aspect of the present application, there is provided a printer comprising a pulse motor configured to drive by inputting a pulse signal, a feeder configured to feed a print-receiving medium by using a driving force of the pulse motor, a thermal head having a plurality of heating elements that is arranged in a direction orthogonal to the transport direction in which the print-receiving medium is fed by the feeder and is configured to at least form respective dots on respective printing lines that is formed by dividing the print-receiving medium in a transport direction in terms of a print resolution, and a controller, the controller being configured to execute a first control that achieves a first coordinated state wherein a pulse/dot ratio between a number of outputs of the pulse signal to the pulse motor and a number of prints of line print data that is formed by dividing print data per each of the printing line when the pulse motor constantly rotates at a first rotation speed is set to a constant first ratio that is not 0, by means of controlling a conduction of the plurality of heating elements and a driving of the pulse motor in coordination, a second control that achieves a second coordinated state wherein the pulse/dot ratio when the pulse motor constantly rotates at a second rotation speed slower than the first rotation speed is set to a constant second ratio that is smaller than the first ratio and not 0, by means of controlling the conduction of the plurality of heating elements and the driving of the pulse motor in coordination, and a switching control that gradually decreases the pulse/dot ratio from the first ratio to the second ratio when the first coordinated state is switched to the second coordinated state, and gradually increases the pulse/dot ratio from the second ratio to the first ratio when the second coordinated state is switched to the first coordinated state, by means of controlling the conduction of the plurality of heating elements and the driving of the pulse motor in coordination.

DETAILED DESCRIPTION OF THE PREFERRED EMBODIMENTS

The following describes an embodiment of the present disclosure with reference to accompanying drawings. Note that, in the descriptions below, the terms "up," "down," "front," "rear," and "width" of the label producing apparatus 1 respectively correspond to the direction of the arrows suitably indicated in the respective figures, such as FIG. 1, and the term "thickness" of the label producing apparatus 1 denotes the thickness in the front-rear direction.

Overall Structure of Label Producing Apparatus

Figure 1:
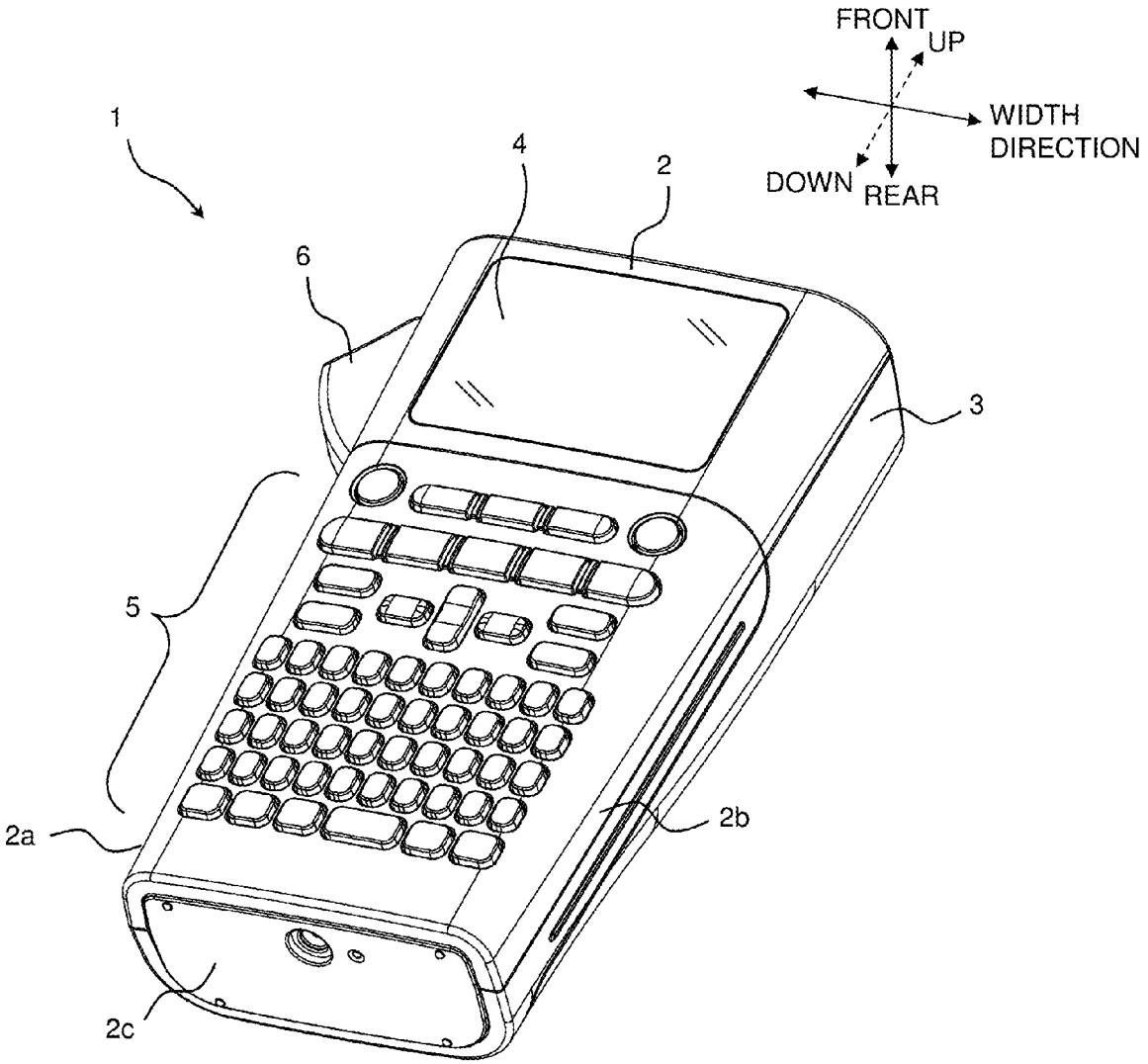
FIG. 1 is a perspective view showing the outer appearance of the frontward side of a label producing apparatus of an embodiment of the present disclosure.
Figure 2:
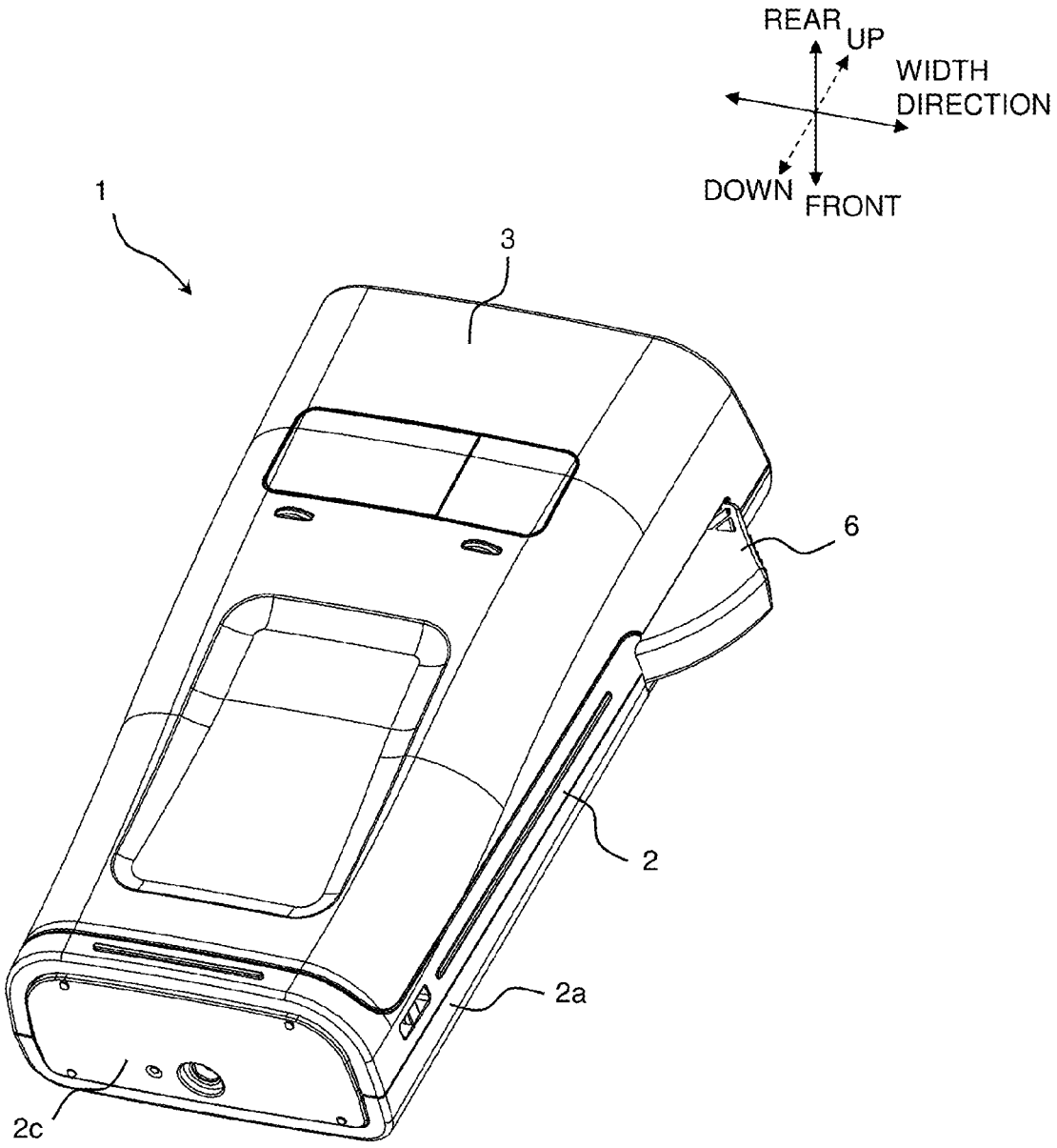
FIG. 2 is a perspective view showing the outer appearance of the rearward side of a label producing apparatus of an embodiment of the present disclosure.

As shown in FIG. 1 and FIG. 2, a label producing apparatus 1 (equivalent to the printer) is a handheld electronic device held in the hands of an operator. The label producing apparatus 1 comprises an apparatus main body 2 and a cover 3 detachably mounted to the rear surface of this apparatus main body 2.

The apparatus main body 2 has a thin, flat substantially rectangular parallelepiped shape that is long in the up-down direction. A liquid crystal display part 4 for displaying print data, setting screens, and the like is disposed in the upper area of the front surface of this apparatus main body 2, and a keyboard 5 for operating the label producing apparatus 1 is disposed on the lower side of the liquid crystal display part 4. A key group that includes character keys for characters, symbols, numbers, and the like, and various function keys is disposed on this keyboard 5. A cut operation lever 6 for cutting a label tape with print (described later) is disposed in the upper area of a side wall part 2*a* on one width-direction side (left side in FIG. 1, right side in FIG. 2) of the apparatus main body 2.

Cover Structure

Figure 3:
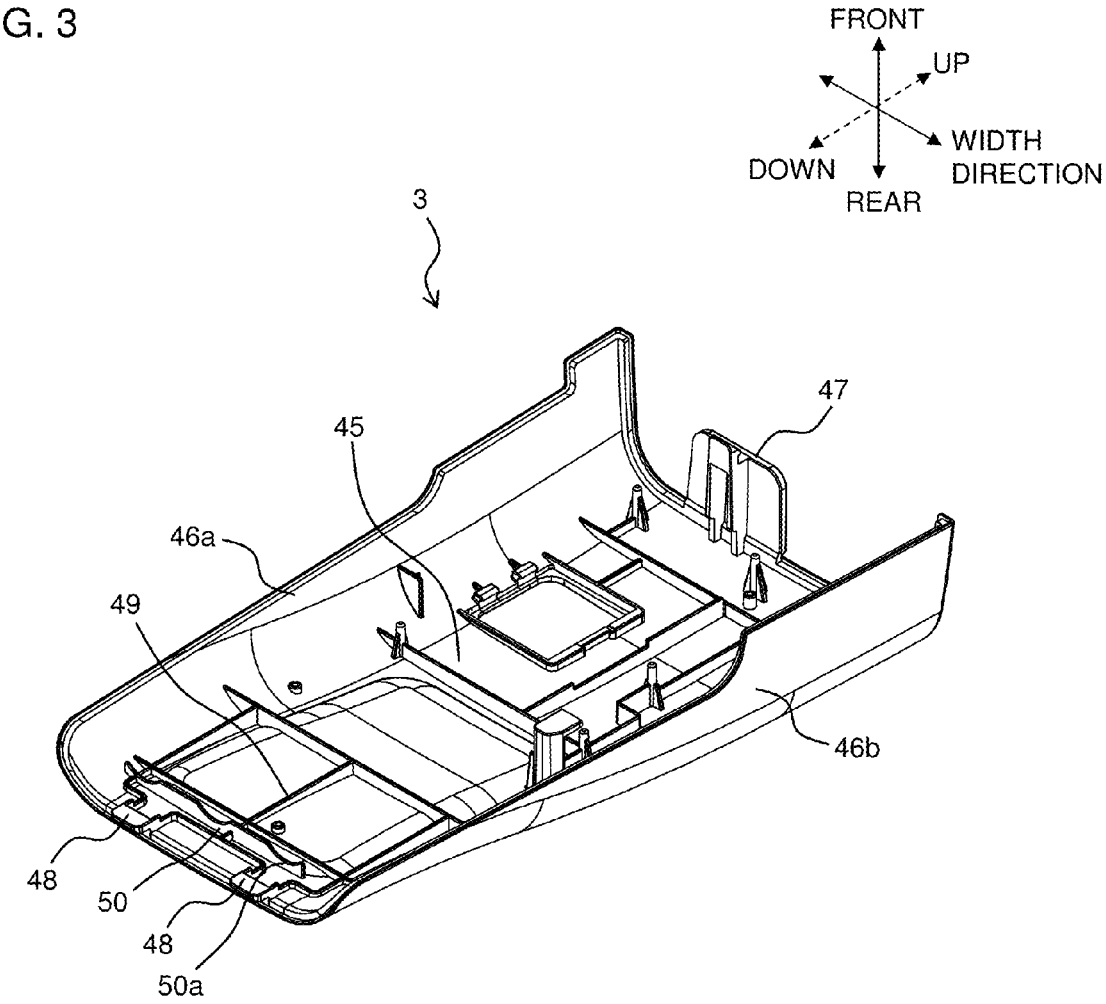
FIG. 3 is a perspective view showing the structure of the inside of the cover.

FIG. 3 shows the structure of the inside of the cover 3. As shown in FIG. 3, the cover 3 comprises a bottom part 45, a side surface part 46*a* that stands on one width-direction side (upper left side in FIG. 3) of the bottom part 45, and a side surface part 46*b* that stands on the other width-direction side (lower right side in FIG. 3) of the bottom part 45, and is formed so that the side view from the up-down direction is substantially box-like in shape with an opening on the left. A protruding piece 47 that stands in the thickness direction of the apparatus main body 2 from the substantial center is formed in the upper end area of the bottom part 45. The side surface part 46*a* on the above described one width-direction side is formed into a stepped shape in which the height in the standing direction (the same direction as the front-rear direction) gradually decreases from the upper end area to the lower end area in three steps. Similarly, the side surface part 46*b* on the above described other width-direction side is formed into a stepped shape in which the height in the standing direction gradually decreases from the upper end area to the lower end area in two steps.

An insertion piece 48 that inserts into an engaging hole 2*c*1 (refer to FIG. 4 described later) disposed in two locations in the width direction of a lower part 2*c* of the apparatus main body 2 when the cover 3 is mounted in the rear surface area of the apparatus main body 2 is disposed in two width-direction locations on the lower end of the bottom part 45 of the cover 3.

Further, a square frame-shaped first rib 49 set in the width direction and up-down direction of the apparatus main body 2, and a second rib 50 comprising an arc-shaped notch 50*a* in three width-direction locations, disposed further in proximity to the lower side of the first rib 49, stand in the lower area of the bottom part 45 of the cover 3. The heights of the ribs 49, 50 are respectively set so that the height of the standing-direction upper end of the first rib 49 and the height in the standing direction of the arc center area of the notch 50*a* of the second rib 50 are substantially the same.

The first rib 49 comes in contact with and presses against a front surface of a battery (not shown) when the battery is stored in a battery storage part 30 (refer to FIG. 4, FIG. 5, and the like described later) and the cover 3 is mounted in the rear surface area of the apparatus main body 2.

In mounting the cover 3 in the rear surface area of the apparatus main body 2, the two insertion pieces 48 of the lower end of the cover 3 are inserted into the two engaging holes 2*c*1 of the lower part 2*c* of the apparatus main body 2, and the protruding piece 47 of the upper end of the cover 3 is inserted and locked into a locking opening part 9 (refer to FIG. 4 described later) of the upper end of the apparatus main body 2. With this arrangement, the cover 3 is mounted in the rear surface area of the apparatus main body 2, and covers a label producing part 10 and the battery storage part 30 of the apparatus main body 2 (refer to FIG. 4 described later).

Label Producing Mechanism of Label Producing Apparatus

Figure 4:
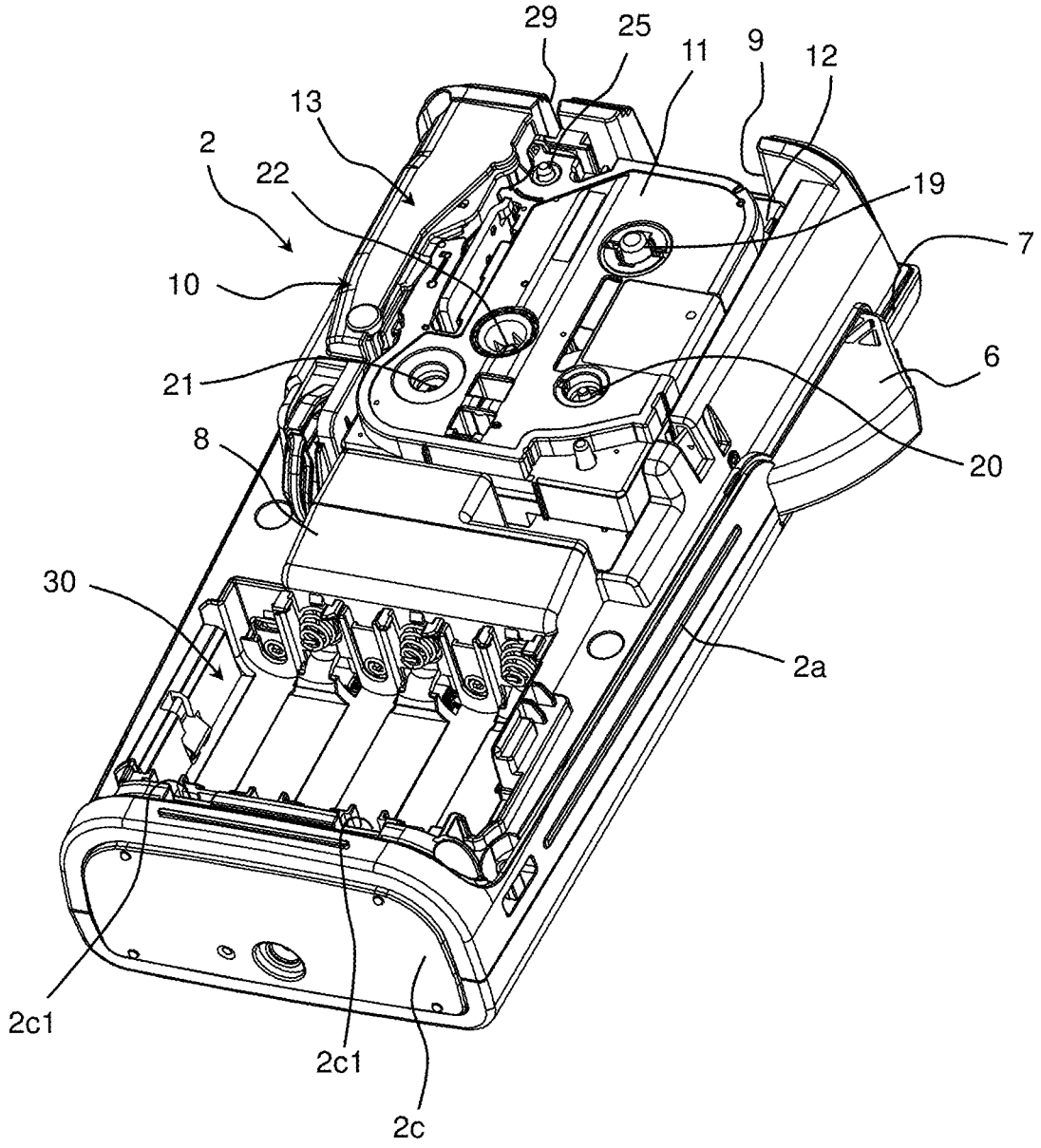
FIG. 4 is a perspective view showing the internal structure of the rearward side of the apparatus main body with the battery not stored.
Figure 5:
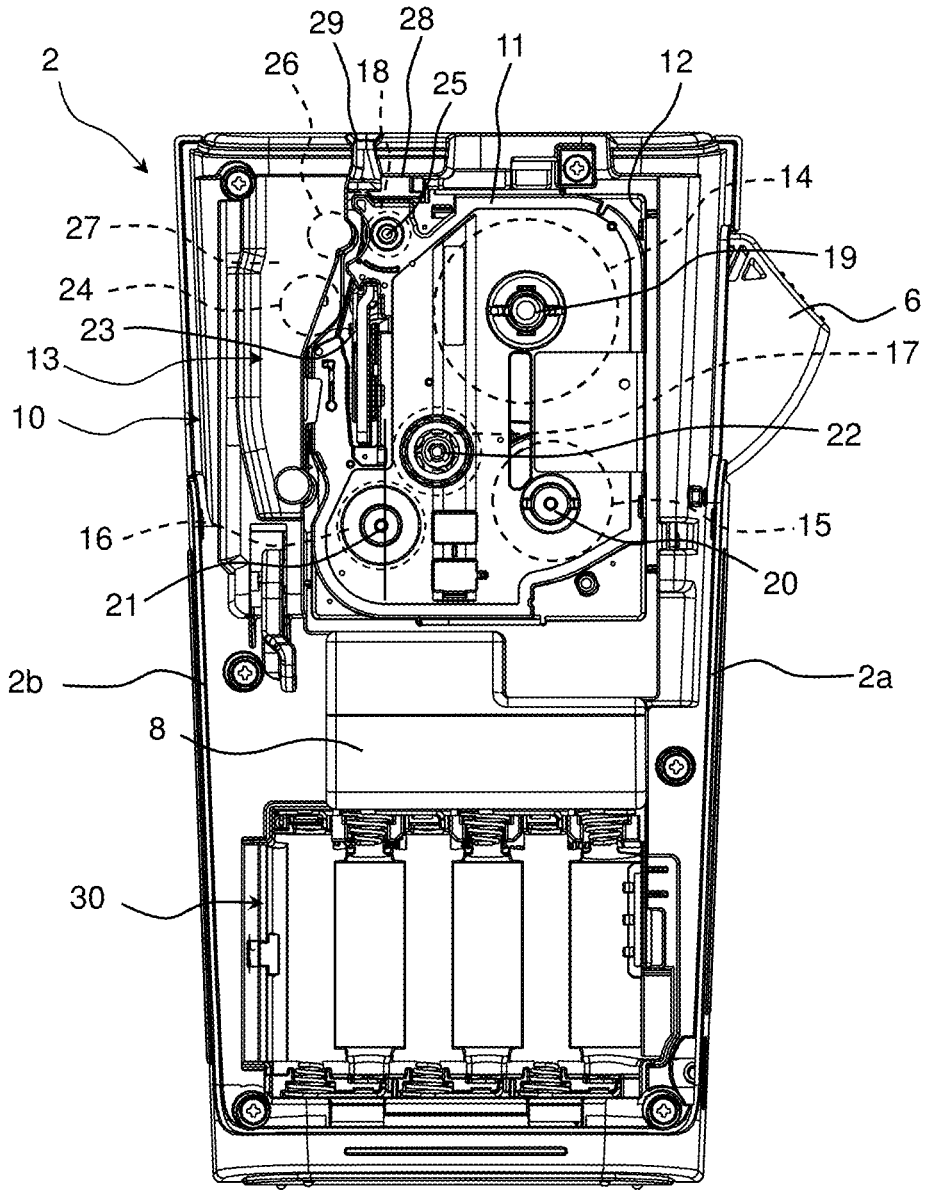
FIG. 5 is a plan view showing the internal structure of the rearward side of the apparatus main body with the battery not stored.

As shown in FIG. 4 and FIG. 5, the apparatus main body 2 comprises the label producing part 10 and the battery storage part 30. The label producing part 10 and the battery storage part 30 are separated by a housing part 8 that houses a control board (not shown), a pulse motor 63*a* (refer to FIG. 6 described later) for driving a platen roller 24 described later, and the like. Further, as shown in FIG. 4 and FIG. 5, a step part 7 comprising a shape corresponding to the end area of the releasing side of the cover 3 is disposed on the side wall parts 2*a* and 2*b* of the above described one and other width-direction sides of the apparatus main body 2. A locking opening 9 is disposed on the upper end of the apparatus main body 2.

The label producing part 10 comprises a concave-shaped cartridge holder 12 for detachably mounting a cartridge 11, disposed so as to occupy a majority of the substantial upper half of the apparatus main body 2, and a printing and feeding mechanism 13 disposed in a region that includes the above described other width-direction side (left side in FIG. 4 and FIG. 5) of the cartridge holder 12. The cartridge 11, as shown in FIG. 5, internally comprises a base tape roll 14, a cover film roll 15, an ink ribbon roll 16, an ink ribbon take-up roller 17, and a feeding roller 18.

The printing and feeding mechanism 13 comprises a support shaft 19 of the base tape roll 14, a support shaft 20 of the cover film roll 15, a support shaft 21 of the ink ribbon roll 16, a take-up shaft 22 of the ink ribbon, a thermal head 23, the platen roller 24 (equivalent to the feeder), a driving shaft 25 of the feeding roller 18, a pressure roller 26, and the like. The platen roller 24 and the pressure roller 26 are installed on a roll holder 27, and can be switched between a printing and feeding position (the position shown in FIG. 5 and the like) where they contact the thermal head 23 and the feeding roller 18, and a standby position (not shown) where they are separated from the thermal head 23 and the feeding roller 18, respectively, by the oscillation of the roll holder 27.

During print label production, the platen roller 24 and the pressure roller 26 are switched to the printing and feeding position. The platen roller 24 switched to the printing and feeding position rotates by the driving from the pulse motor 63*a* on the apparatus main body 2 side, and presses the cover film (equivalent to the print-receiving medium; not shown) fed out from the cover film roll 15 and the ink ribbon (not shown) fed out from the ink ribbon roll 16 against the thermal head 23. With this arrangement, the thermal head 23 performs desired printing in accordance with print data on the cover film, and the platen roller 24 feeds the cover film and ink ribbon on which printing has ended toward the feeding roller 18. The ink ribbon on which printing has ended is subsequently separated from the cover film and taken up by the ink ribbon take-up roller 17.

On the other hand, the pressure roller 26 switched to the printing and feeding position presses the cover film on which printing has ended, fed by the platen roller 24, and the base tape (not shown) fed out from the base tape roll 14 against the feeding roller 18 that rotates by the driving from the driving shaft 25 connected to the pulse motor 63*a* (refer to FIG. 6 described later). With this arrangement, the feeding roller 18 feeds a label tape with print toward a label discharging exit 29 disposed on the upper end of the apparatus main body 2 while bonding the cover film on which printing has ended and the base tape to form the label tape with print. Then, an operator manually operates the cut operation lever 6 at a predetermined point in time when the label tape with print has been discharged from the label discharging exit 29, thereby operating a cutter 28 arranged near the label discharging exit 29 and cutting the label tape with print to form a print label of a desired length.

The battery storage part 30 is formed as a concave part that is long in the width direction of the apparatus main body 2 and has a substantially rectangular shape in a plan view, and can alternatively store a plurality (six in this example) of cylindrical-shaped dry cells (not shown) or one rectangular parallelepiped shaped battery (a lithium ion battery pack, for example; not shown).

Control System of Label Producing Apparatus

Next, the control system of the label producing apparatus 1 will be described with reference to FIG. 6.

Figure 6:
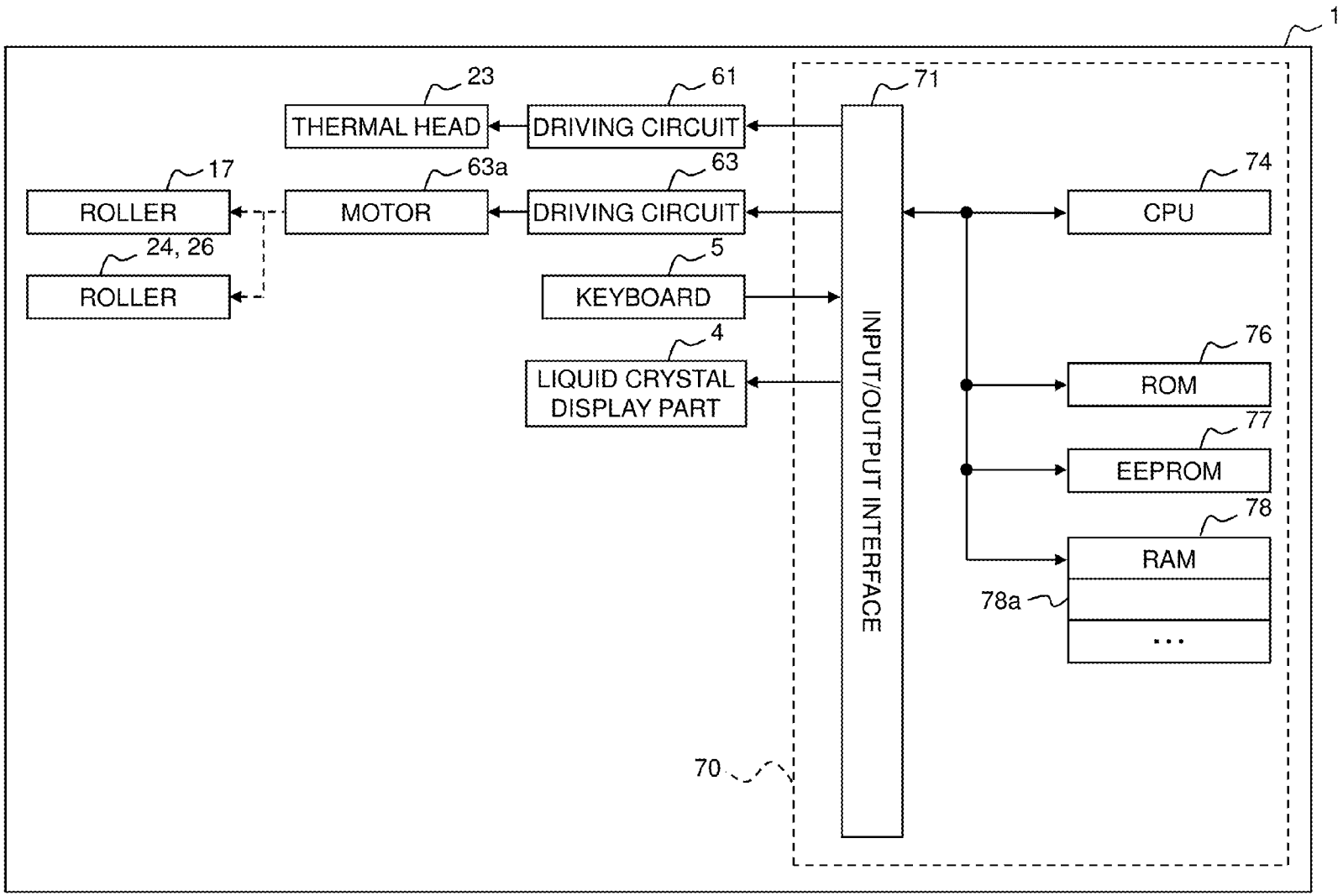
FIG. 6 is a functional block diagram showing the control system of the label producing apparatus.

As shown in FIG. 6, a control circuit 70 is disposed on the control board (not shown) of the label producing apparatus 1. A CPU 74 is disposed on the control circuit 70, and a ROM 76, a RAM 78, an EEPROM 77, and an input/output interface 71 are connected to the CPU 74 via a data bus. Note that nonvolatile memory such as flash memory may be used in place of the EEPROM 77.

Various programs (such as a control program that executes the respective procedures of the flows of FIG. 12 and FIG. 13 described later, for example) required for controlling the label producing apparatus 1 are stored in the ROM 76. The CPU 74 performs various operations based on the various programs stored in this ROM 76.

The RAM 78 temporarily stores various operation results from the CPU 74. A label image memory 78A and the like are disposed on this RAM 78.

The EEPROM 77 stores various information.

A thermal head driving circuit 61, a motor driving circuit 63, the above described keyboard 5, the above described liquid crystal display part 4, and the like are connected to the input/output interface 71.

The thermal head driving circuit 61 drives the above described thermal head 23. The thermal head 23 comprises a plurality of heating elements (not shown) arranged in a direction orthogonal to the transport direction. This plurality of heating elements performs printing by forming dots on the respective printing lines of the cover film, based on the control of the above described thermal head driving circuit 61 (details described later).

The motor driving circuit 63 rotationally drives the pulse motor 63*a* and controls the rotation speed by a pulse signal applied to the above described pulse motor 63*a*. The motor driving circuit 63 drives the pulse motor 63*a*, thereby rotating the above described ink ribbon take-up roller 17 via a gear (not shown). Further, the rotation of the gear is transmitted to a platen roller gear and a pressure roller gear (not shown), and the platen roller gear and the pressure roller gear then rotate, rotating the above described platen roller 24 and the pressure roller 26.

In such a control system wherein the control circuit 70 serves as the core, when the operator inputs a predetermined label production instruction via the keyboard 5, the platen roller 24, the pressure roller 26, and the like are driven via the motor driving circuit 63 and the pulse motor 63*a*, and the cover film and the like are fed. Further, in synchronization therewith, a plurality of heating elements of the thermal head 23 is selectively heated and driven via the thermal head driving circuit 61, and printing of a print object is performed on the above described fed cover film. With this arrangement, in the end, a print label wherein the print object is formed on the cover film is produced.

Special Characteristic of the Embodiment

The special characteristic of this embodiment lies in the technique when the coordination mode is switched in the coordinated control between tape feeding by the above described pulse motor 63*a* and print formation (printing) by the above described thermal head 23. In the following, details on the functions will be described in order.

General Characteristics of Pulse Motor

Figure 7A:
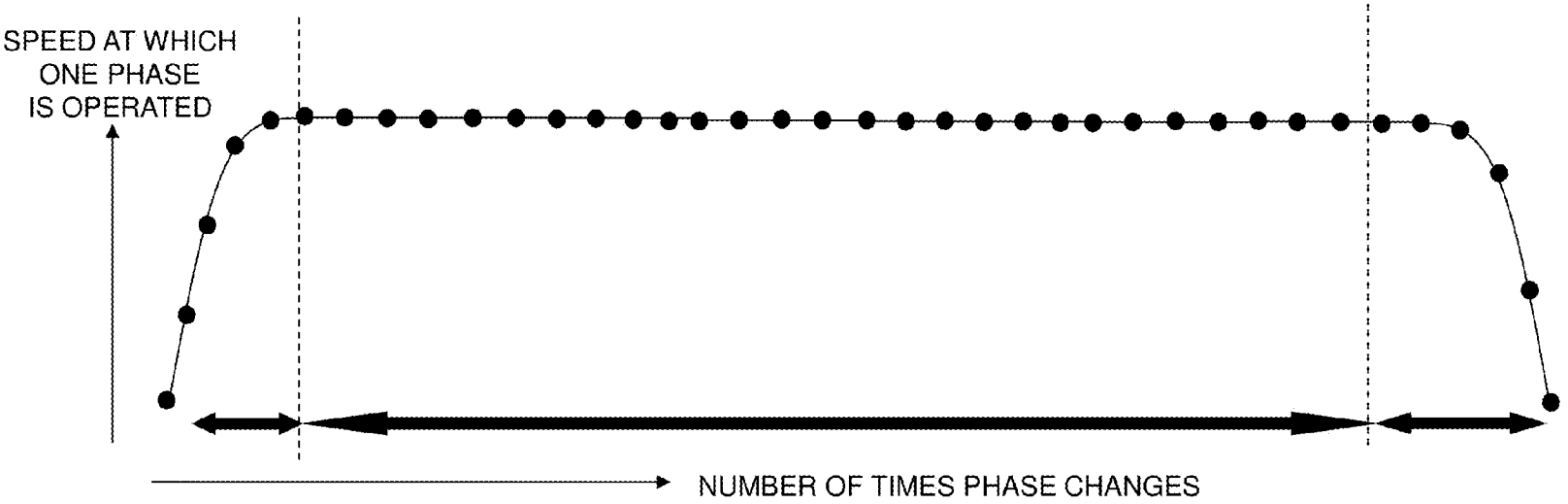
FIG. 7A is an explanatory view for conceptually explaining an example in which the pulse motor is controlled using four pulses as a dot unit.
Figure 7B:
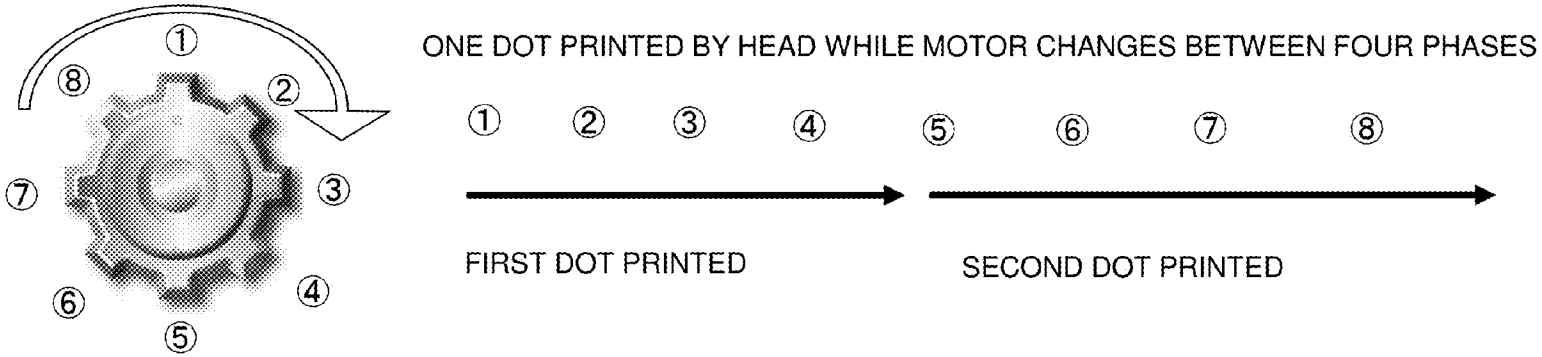
FIG. 7B is an explanatory view for conceptually explaining an example in which the pulse motor is controlled using four pulses as a dot unit.

In the label producing apparatus 1 of this embodiment, the platen roller 24 feeds the cover film by the driving force of the above described pulse motor 63*a*, and the thermal head 23 performs desired printing on the cover film thus fed. The pulse motor 63*a*, as shown in FIG. 7A and FIG. 7B, rotates at a predetermined angle by applying a single pulse signal (switching the excitation phase to the next state), and the rotation speed is controlled by shortening and lengthening the interval at which the pulse is applied. The rotation speed can be accelerated by gradually shortening the interval, and decelerated by gradually lengthening the interval.

Further, the thermal head 23 comprises a plurality of heating elements arranged in a direction orthogonal to the transport direction. This plurality of heating elements performs printing by forming dots on the respective printing lines of the cover film. Specifically, in response to the cover film being fed by the platen roller 24 and the printing lines of the cover film sequentially passing the positions of the heating elements, the conduction mode of the heating elements is sequentially switched on a per line print data (section of print data divided into one printing line unit) basis, based on the driving control of the thermal head driving circuit 61. With this arrangement, it is possible for the thermal head 23 to perform printing at a printing speed that matches the feeding speed of the cover film by the platen roller 24. In the example shown in FIG. 7B, the printing of one line print data ("one dot" in the figure) is performed each time four pulse signals are input to the pulse motor 63*a*.

Feeding and Printing Coordination

Figure 8A:
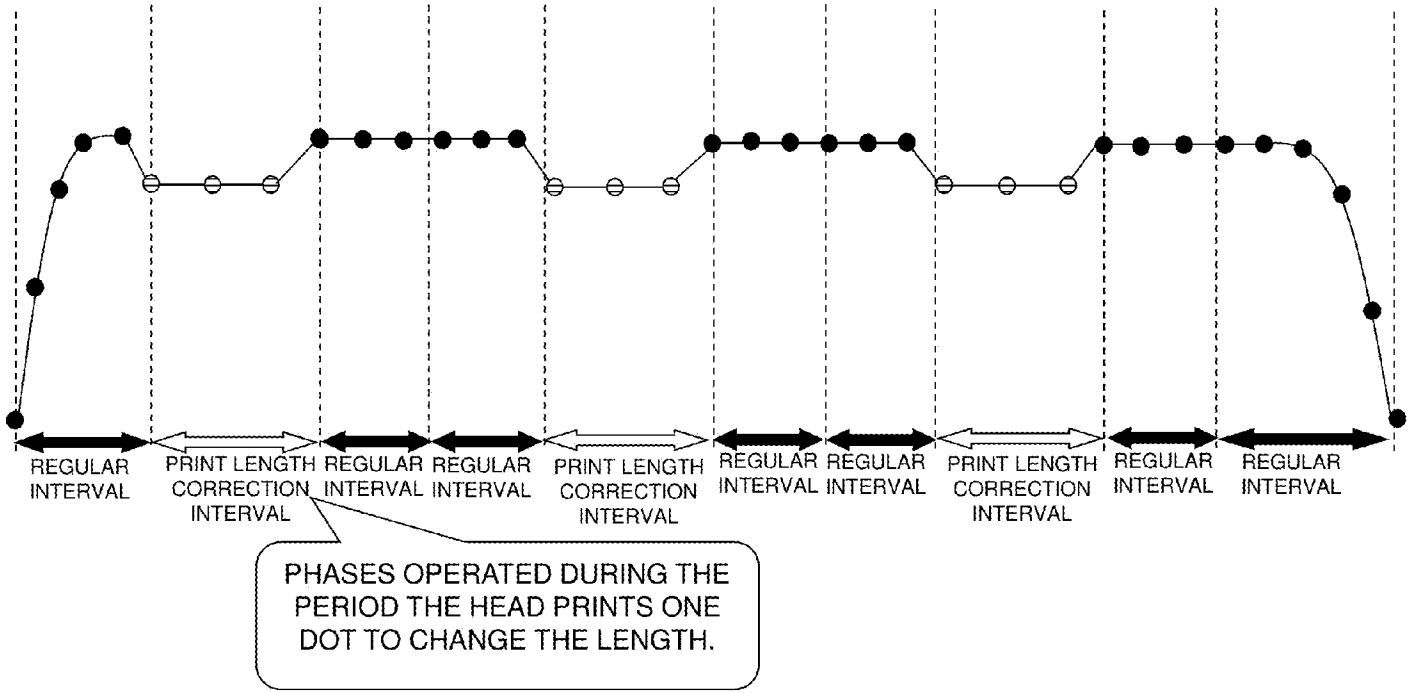
FIG. 8A is an explanatory view for explaining the behavior that changes the pulse/dot ratio in a regular interval and a print length correction interval.
Figure 8B:
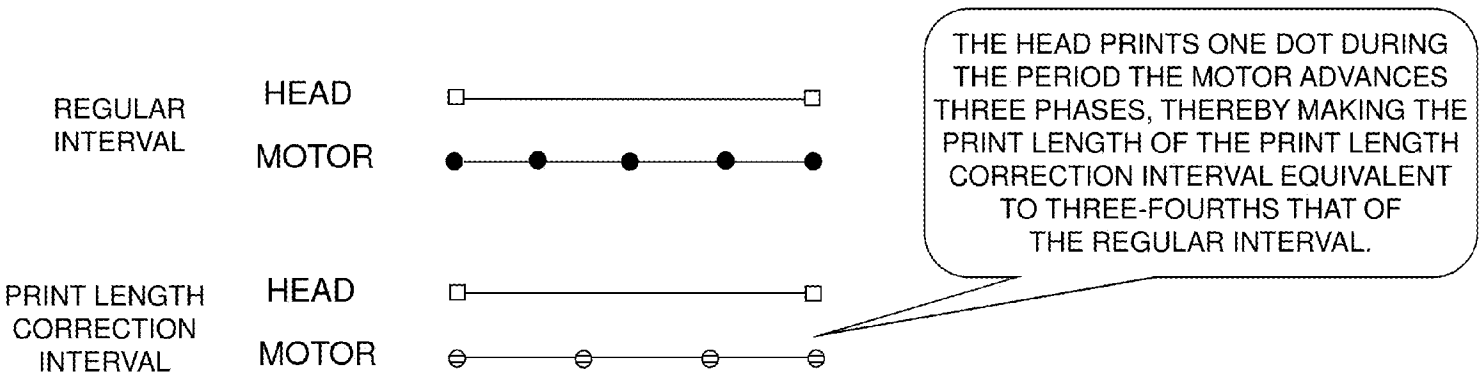
FIG. 8B is an explanatory view for explaining the behavior that changes the pulse/dot ratio in a regular interval and a print length correction interval.

Hence, according to this embodiment, as shown in FIG. 8A and FIG. 8B, two coordinated states are prepared as coordination modes when feeding and printing are performed in coordination as described above.

One is a first coordinated state wherein the conduction of the above described plurality of heating elements and the driving of the above described pulse motor are controlled in coordination (equivalent to "regular interval" in FIG. 8A). In this case, control is performed so that a pulse/dot ratio $\alpha$ (the ratio between the number of outputs of a pulse signal to the pulse motor 63*a* and the number of prints of the line print data) becomes a relatively large ratio (a first ratio $\alpha 1$; 4 pulses/one dot in this example; $\alpha 1=4$), in other words, so that one dot is printed each time the pulse motor 63*a* rotates in an amount equivalent to a relatively large phase by a relatively large number of pulses. As a result, the pulse motor 63*a* constantly rotates at a relatively fast rotation speed (hereinafter suitably referred to as "first rotation speed").

The other is a second coordinated state for suppressing the print length so that it is shorter, wherein the conduction of the above described plurality of heating elements and the driving of the above described pulse motor 63*a* are controlled in coordination (equivalent to "print length correction interval" in FIG. 8A). In this case, control is performed so that the above described pulse/dot ratio $\alpha$ becomes a second ratio $\alpha 2$ (3 pulses/one dot in this example; $\alpha 2=3$) smaller than the above described first ratio $\alpha 1$, in other words, so that one dot is printed each time the pulse motor 63*a* rotates in an amount equivalent to a relatively small phase by a relatively small number of pulses. With this arrangement, the print length of the print length correction interval is equivalent to three-fourths that of the regular interval. Then, the pulse motor 63*a* constantly rotates at a relatively slow rotation speed (hereinafter suitably referred to as "second rotation speed").

If there is a Large Difference in Pulse Motor Rotation Speeds

Figure 9:
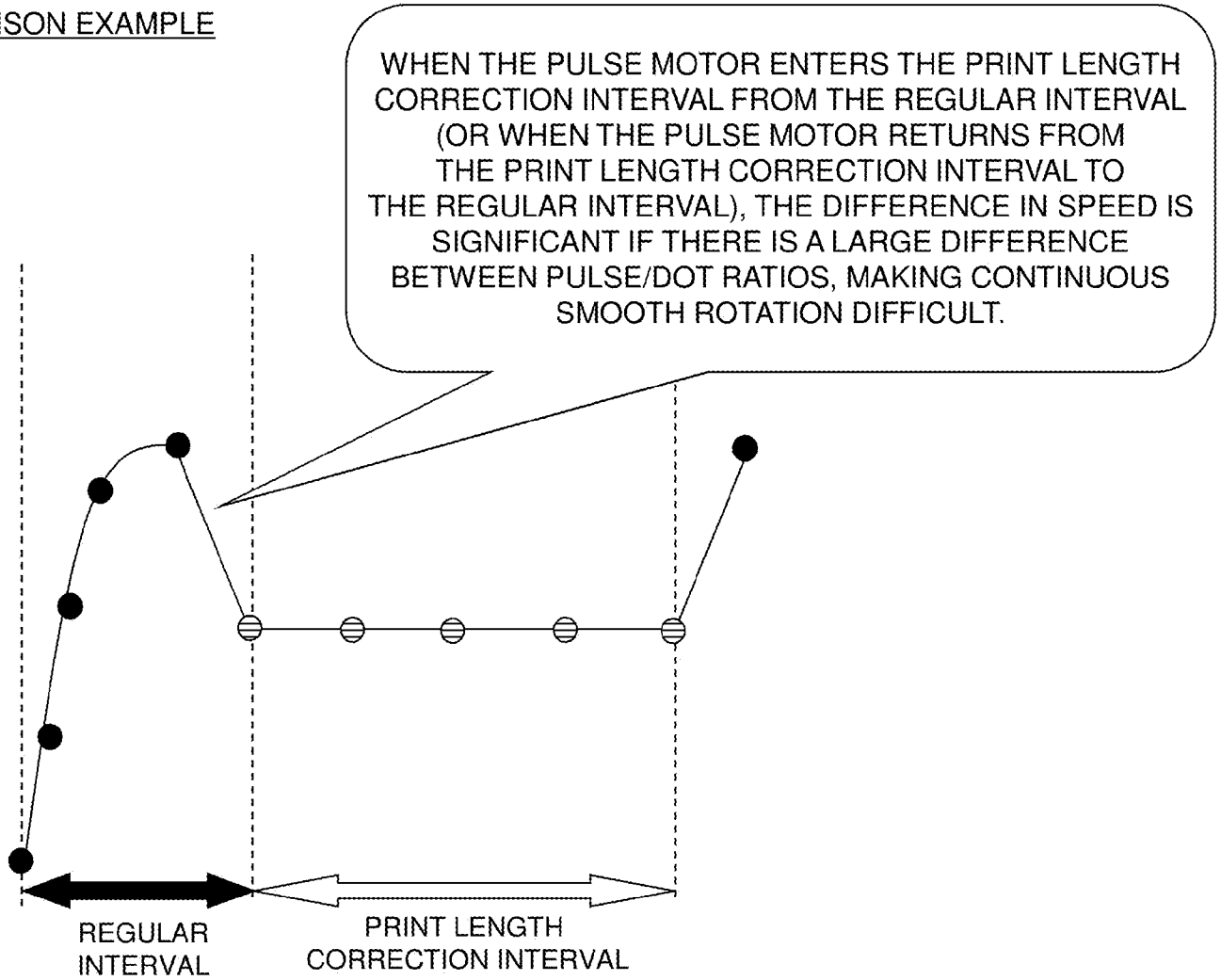
FIG. 9 is an explanatory view showing the behavior of the rotation speed of the pulse motor when the pulse motor transitions from a regular interval to a print length correction interval in a comparison example with respect to an embodiment of the present disclosure.

As described above, according to this embodiment, it is possible to switch between and execute the first coordinated state for achieving a regular print length and the second coordinated state for suppressing the print length. Nevertheless, the pulse motor 63*a* rotates at the relatively fast above described first rotation speed in the first coordinated state and conversely rotates at the relatively slow above described second rotation speed in the second coordinated state, as previously mentioned. As a result, when the conduction of the above described plurality of heating elements of the thermal head 23 and the driving of the above described pulse motor 63*a* are controlled in coordination as described above and the mode is switched from the first coordinated state to the second coordinated state or conversely from the second coordinated state to the first coordinated state, the possibility exists that the input of the pulse signal previously mentioned and the switching of the excitation phase will become mismatched as shown as a comparison example in FIG. 9 if there is a large difference in the rotation speeds of the above described pulse motor 63*a*, causing difficulties in smooth motor operation.

Gradual Decrease and Gradual Increase Control when Switching Coordinated States

Figure 10A:
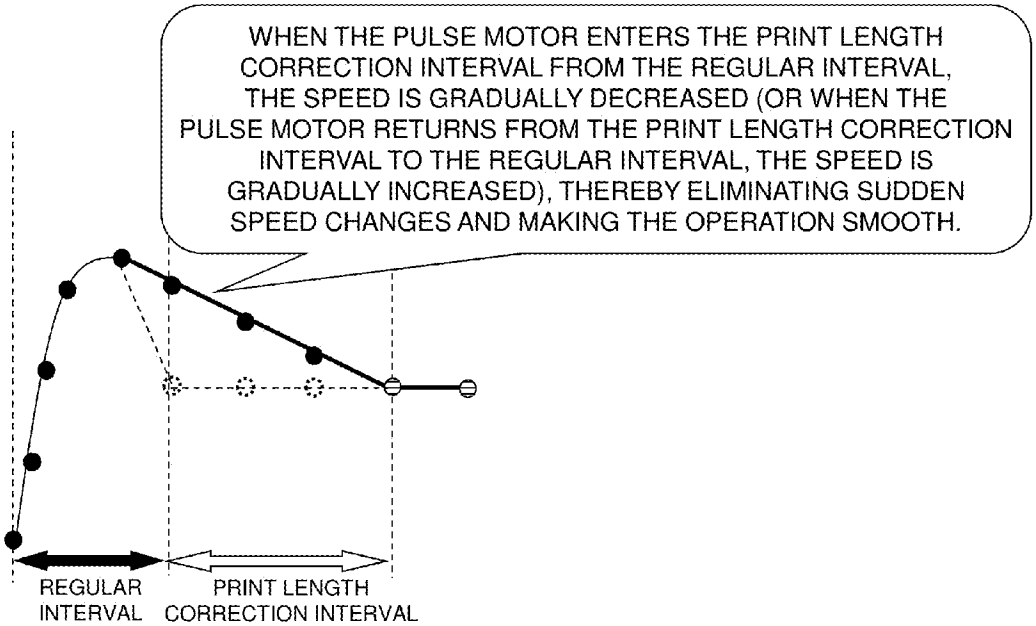
FIG. 10A is an explanatory view showing the behavior of the rotation speed of the pulse motor when the pulse motor transitions from the regular interval to the print length correction interval.
Figure 10B:
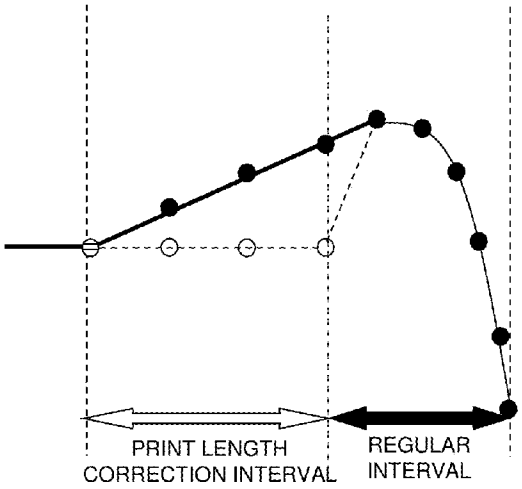
FIG. 10B is an explanatory view showing the behavior of the rotation speed of the pulse motor when the pulse motor returns from the print length correction interval to the regular interval in an embodiment of the present disclosure.

Hence, in this embodiment, when the mode is switched from the first coordinated state to the second coordinated state, the conduction of the above described plurality of heating elements and the driving of the above described pulse motor 63*a* are controlled in coordination so that the pulse/dot ratio is gradually changed (gradually decreased) from the above described first ratio to the above described second ratio, as shown in FIG. 10A. Further, similarly, when the mode is switched from the second coordinated state to the first coordinated state, the conduction of the above described plurality of heating elements and the driving of the above described pulse motor 63*a* are controlled in coordination so that the pulse/dot ratio is gradually changed (gradually increased) from the above described second ratio to the above described first ratio, as shown in FIG. 10B.

Gradual Decrease/Gradual Increase Setting Details of Pulse Motor Rotation Speed

Figure 11:
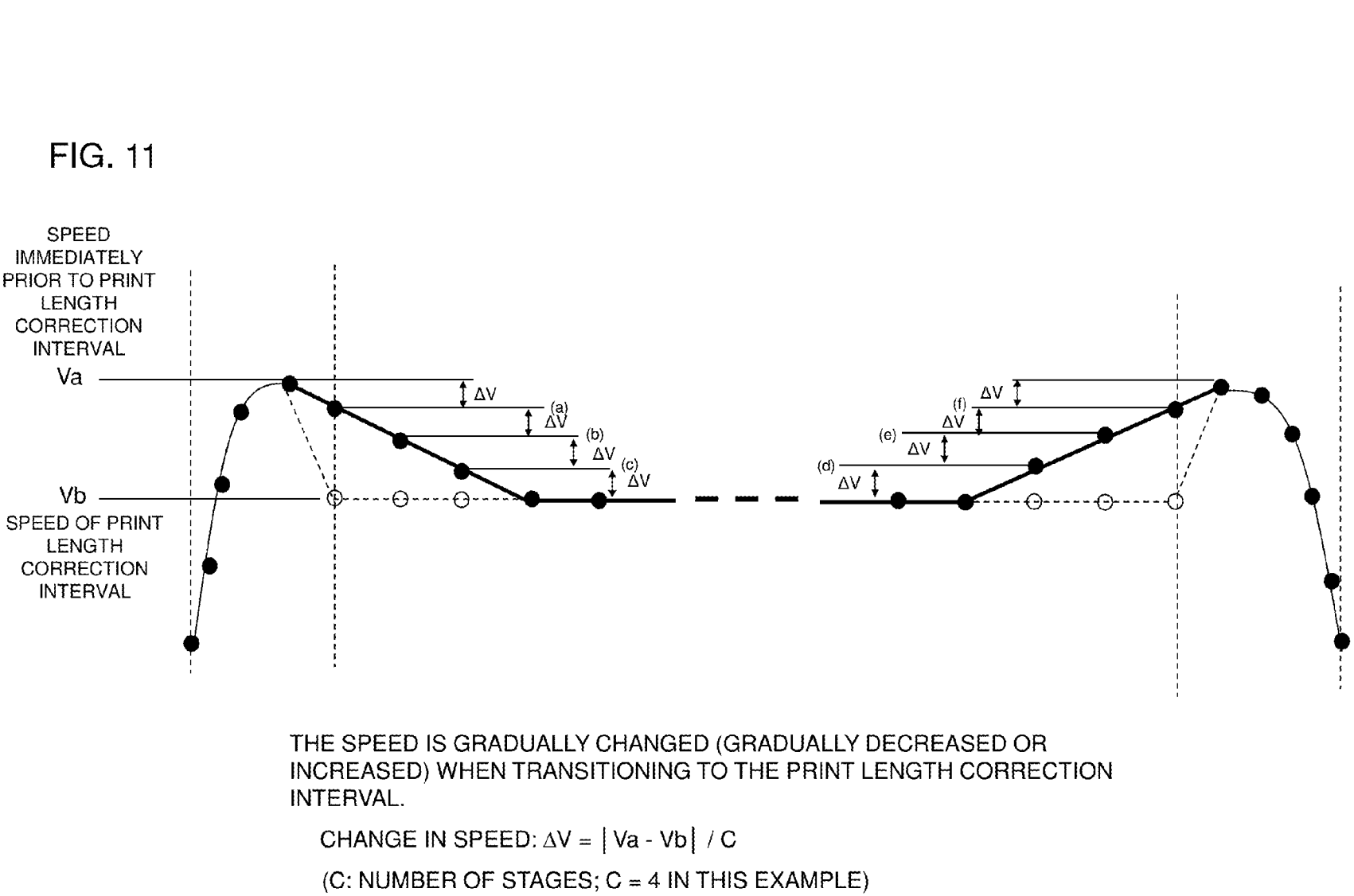
FIG. 11 is an explanatory view showing a specific example of the gradual decrease and gradual increase control of the rotation speed of the pulse motor based on an embodiment of the present disclosure.

Specifically, according to this embodiment, the speed when the pulse motor 63*a* transitions from the regular interval to the print length correction interval (or the speed when the pulse motor 63*a* transitions (returns) from the print length correction interval to the regular speed decrease interval) is gradually increased (or decreased), as shown in FIG. 11.

That is, when the pulse motor 63*a* transitions to the print length correction interval, given Va (a constant speed) as the above described first rotation speed immediately prior to the transition and Vb (a constant speed) as the above described second rotation speed of the print length correction interval that is slower than the first rotation speed, the speed difference $|Va-Vb|$ is changed in stages. In the example shown in FIG. 11, given "4," for example, as a number of stages C and $\Delta V=|Va-Vb|/C$ as a change $\Delta V$ in speed, the speed is gradually decreased using a four-stage change $\Delta V$ with respect to the speed difference $|Va-Vb|$. That is, a first stage decreasing speed of the pulse motor 63*a* immediately after transition to the above described print length correction interval (refer to (a) in FIG. 11) is $Va-\Delta V$, a subsequent second stage decreasing speed (refer to (b) in FIG. 11) is $Va-2\Delta V$, a subsequent third stage decreasing speed (refer to (c) in FIG. 11) is $Va-\Delta 3V$, and then a final fourth stage decreasing speed is $Va-4\Delta V$ (=Vb). As a result, in the print length correction intervals thereafter, the pulse motor 63*a* changes to a low constant speed operation based on the above described Vb.

That is, when the pulse motor 63*a* returns from the print length correction interval to the regular interval as well, the speed is gradually increased using the four-stage change $\Delta V$ with respect to the speed difference $|Va-Vb|$, similar to the above. That is, a first stage increasing speed of the pulse motor 63*a* immediately after the pulse motor 63*a* starts to return from the above described print length correction interval to the regular interval (refer to (d) in FIG. 11) is $Vb+\Delta V$, a subsequent second stage increasing speed (refer to (e) in FIG. 11) is $Vb+2\Delta V$, a subsequent third stage increasing speed (refer to (f) in FIG. 11) is $Vb+\Delta 3V$, and then a final fourth stage increasing speed is $Vb+4\Delta V$ (=Va). As a result, in the regular intervals thereafter, the pulse motor 63*a* changes to a high constant speed operation based on the above described Va.

Note that while, in order to clarify the technique, FIG. 11 describes an illustrative scenario of the above described gradual decrease control after the high constant speed operation of the above described first rotation speed Va is achieved immediately after the pulse motor 63*a* is accelerated (subject to through-up) from speed 0 at the start of printing operation, the gradual decrease control of this embodiment is not limited to this timing (refer to FIG. 8A). Similarly, while FIG. 11 describes an illustrative scenario of the above described gradual increase control when the rotation speed returns from the above described second rotation speed Vb immediately before the pulse motor 63*a* is decelerated (subject to through-down) from the first rotation speed Va at the end of printing, the gradual increase control of this embodiment is not limited to this timing (refer to FIG. 8A).

Control Flow

Figure 12:
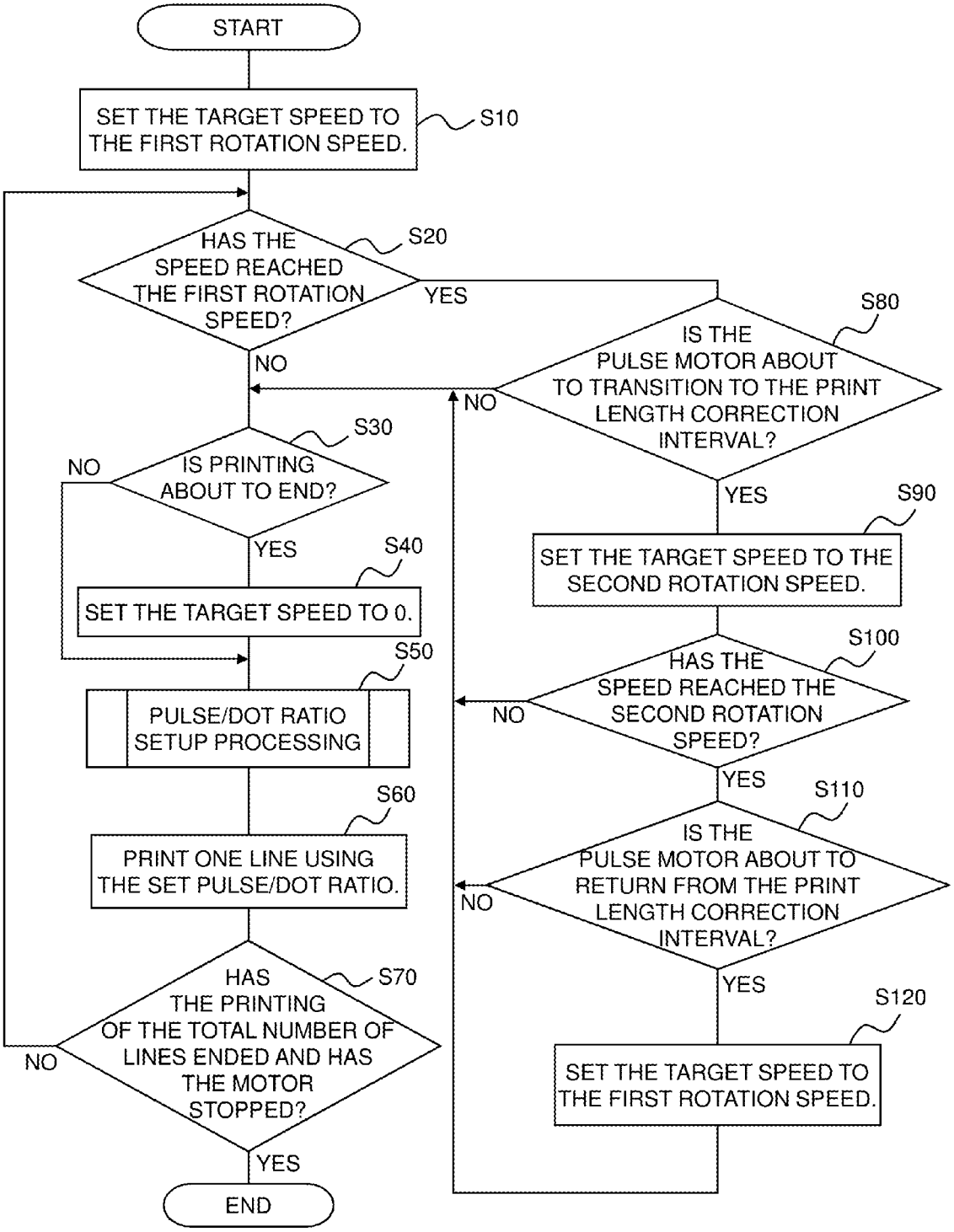
FIG. 12 is a flowchart showing the control procedure executed by the CPU.
Figure 13:
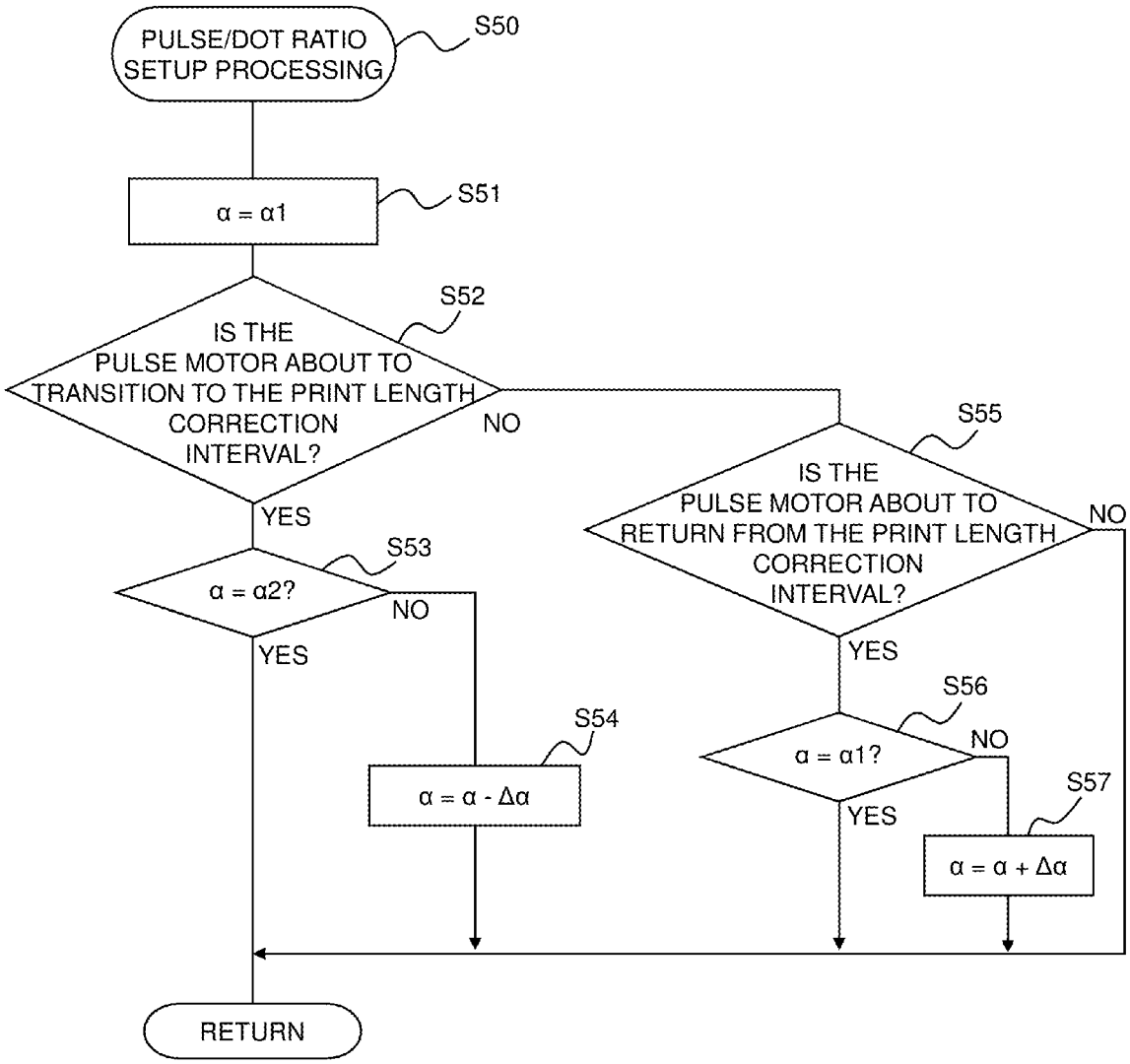
FIG. 13 is a flowchart showing the detailed procedure of the pulse/dot ratio setup processing of step S50.

The following describes the control procedure executed by the CPU 74 of the control circuit 70 for achieving the above described technique, using the flowcharts shown in FIG. 12 and FIG. 13.

In FIG. 12, the flow is started by the generation of the corresponding above described print data based on a suitable operation and a suitable printing start instruction by the operator on the keyboard 5 of the label producing apparatus 1, for example. First, in step S10, the CPU 74 outputs a control signal to the motor driving circuit 63 at the start of the printing operation and controls the pulse signal applied to the pulse motor 63*a*, thereby setting the target speed of the pulse motor 63*a* to the above described first rotation speed Va.

Subsequently, in step S20, the CPU 74 determines whether or not the actual speed of the pulse motor 63*a* has reached the above described first rotation speed Va Immediately after printing is started and the pulse motor 63*a* starts rotation by the above described step S10, the actual speed has not reached the first rotation speed and therefore the condition of step S20 is not satisfied (step S20: No) and the flow proceeds to step S30.

In step S30, the CPU 74 determines whether or not the timing is that at which the printing of the thermal head 23 ends, based on the above described print data. If the timing is immediately after printing has started as described above, the condition of step S30 is not satisfied (step S30: No) and the flow proceeds to step S50.

In step S50, the CPU 74 executes the setup processing of the pulse/dot ratio $\alpha$ when the conduction of the plurality of heating elements and the driving of the pulse motor 63*a* are to be controlled in coordination (described in detail later using FIG. 13).

Subsequently, in step S60, the CPU 74 executes the printing of one line based on the pulse/dot ratio $\alpha$ set in the above described step S50. That is, the CPU 74 outputs a control signal to the motor driving circuit 63 to apply a pulse signal to the pulse motor 63*a* at a cycle based on a preset pulse cycle and rotationally drive the pulse motor 63*a* in an amount equivalent to one pulse. As a result, the CPU 74 feeds the cover film in an amount equivalent to a predetermined distance corresponding to the printing of one line based on the above described pulse/dot ratio $\alpha$. On the other hand, the CPU 74 outputs a control signal to the thermal head driving circuit 61 to supply electricity to the plurality of heating regions of the thermal head 23 at a cycle based on the preset above described pulse cycle and print one line corresponding to the line print data on the cover film.

As described later, the pulse/dot ratio $\alpha$ of regular intervals other than print length correction intervals is considered to be $\alpha=\alpha 1$, a relatively large value. Accordingly, in the above described regular interval, the printing of the above described one line is executed on a per relatively large feeding distance basis. After the above described processing of step S60, the flow proceeds to step S70.

In step S70, the CPU 74 determines whether or not the printing of the total number of printing lines has ended on the cover film based on the above described print data and the like. Until the printing of the total number of lines ends, the condition is not satisfied (step S70: No), the flow returns to the above described step S20, and the procedure of step S20 to step S70 is repeated in the same manner as described above.

In such a repetition as described above, when a certain amount of time has elapsed after the start of rotation of the pulse motor 63*a* (in other words, after the start of printing) and the actual speed of the pulse motor 63*a* reaches the first rotation speed Va, the condition of the previously mentioned step S20 is satisfied (step S20: Yes), and the flow proceeds to step S80. In step S80, the CPU 74 determines whether or not the pulse motor 63*a* is to transition to the print length correction interval (wherein the rotation speed of the pulse motor 63*a* is set to the above described second rotation speed Vb, which is slower than the above described first rotation speed Va), based on the above described print data. If the timing is not yet that at which the pulse motor 63*a* transitions to the print length correction interval, the condition of step S80 is not satisfied (step S80: No), the flow returns to the above described step S30, and the same procedure as described above is thereafter repeated.

On the other hand, if the timing is that at which the pulse motor 63*a* is to transition to the above described print length correction interval based on the print data, the condition of the above described step S80 is satisfied (step S80: Yes), and the flow proceeds to step S90.

In step S90, the CPU 74 outputs a control signal to the motor driving circuit 63 and controls the pulse signal applied to the pulse motor 63*a*, thereby setting the target speed of the pulse motor 63*a* to the above described second rotation speed Vb corresponding to the print length correction interval.

Subsequently, in step S100, the CPU 74 determines whether or not the actual speed of the pulse motor 63*a* has reached the above described second rotation speed Vb (decreased to Vb). Immediately after transition to the above described print length correction interval is started, the pulse/dot ratio $\alpha$ is gradually decreased toward $\alpha 2$ in step S50 described later, and corresponding deceleration is executed in step S60, the speed has not yet decreased to the second rotation speed and therefore the condition of step S100 is not satisfied (step S100: No), the flow proceeds to step S30, and the same procedure as described above is thereafter repeated. Once the speed decrease gradually advances by step S50 and step S60 and the speed decreases to the second rotation speed due to the repetition, the condition of step S100 is satisfied (step S100: Yes) and the flow proceeds to step S110.

In step S110, the CPU 74 determines whether or not the above described print length correction interval has ended and the pulse motor 63*a* is to return to the original regular interval, based on the above described print data. Immediately after the pulse motor 63*a* transitions to the above described print length correction interval, (the timing is not yet that at which the pulse motor 63*a* returns to the regular interval and therefore) the condition of step S110 is not satisfied (step S110: No), the flow proceeds to step S30, and the same procedure as described above is thereafter repeated. Once the pulse motor 63*a* progresses through print length correction interval during the repetition and the timing is that at which the pulse motor 63*a* returns to the regular interval, the condition of step S110 is satisfied (step S110: Yes), and the flow proceeds to step S120.

In step S120, the CPU 74 outputs a control signal to the motor driving circuit 63 and controls the pulse signal applied to the pulse motor 63*a*, thereby setting the target speed of the pulse motor 63*a* to the above described first rotation speed Va corresponding to the original regular interval. Subsequently, the flow returns to the above described step S30 and the same procedure as described above is thereafter repeated.

Then, the printing is continued by the above described repetition and, when the timing is that at which the printing of the thermal head 23 is to end (the end of printing is approaching) based on the print data, the condition of the previously mentioned step S30 is satisfied (step S30: Yes) and the flow proceeds to step S40.

In step S40, the CPU 74 controls the pulse signal applied to the pulse motor 63*a* by the motor driving circuit 63 to set the target speed to "0." Note that the processing content of the CPU 74 executed in this step S40 and the above described step S10 is equivalent to the third control described in the claims. In the subsequent step S50 and thereafter, the same procedure as described above is repeated. Due to the repetition, the speed decrease gradually advances by step S50 and step S60 and the speed of the pulse motor 63*a* decreases toward a stop until the printing of the total number of lines ends based on the print data.

Then, when the above described motor speed decreases due to the above described repetition and the printing of the total number of lines (on the cover film) ends based on the print data, the condition of step S70 is satisfied (step S70: Yes) and the flow is terminated.

Pulse/Dot Ratio Setup Processing

Next, the details of the pulse/dot ratio setup processing of step S50 will be described using the flowchart of FIG. 13.

In FIG. 13, in step S51, the CPU 74 first sets the pulse/dot ratio $\alpha$ to the first ratio $\alpha 1$, which is a relatively large value corresponding to the previously mentioned regular interval.

Subsequently, in step S52, the CPU 74 determines whether or not the pulse motor 63*a* is to transition to the print length correction interval (wherein the rotation speed of the pulse motor 63*a* is set to the above described second rotation speed Vb, which is slower than the above described first rotation speed Va), based on the above described print data, similar to the above described step S80.

If the pulse motor 63*a* is to transition to the print length correction interval, the condition of step S52 is satisfied (step S52: Yes) and the flow proceeds to step S53. If the pulse motor 63*a* is not to transition to the print length correction interval, the condition of step S52 is not satisfied (step S52: No) and the flow proceeds to step S55.

In step S53, the CPU 74 determines whether or not the above described pulse/dot ratio $\alpha$ has reached the second ratio $\alpha 2$, which is a relatively small value corresponding to the previously mentioned print length correction interval.

Immediately after the pulse motor 63*a* transitions to the print length correction interval, the pulse/dot ratio $\alpha$ has not reached the second ratio $\alpha 2$ and therefore the condition of step S53 is not satisfied (step S53: No), and the flow proceeds to step S54. In step S54, the CPU 74 decreases the pulse/dot ratio $\alpha$ in an amount equivalent to the speed change $\Delta\alpha$, thereby gradually decreasing the motor rotation speed. In the previously mentioned example, $\Delta V=|Va-Vb|/C$ (C: Number of stages=4) and the speed is gradually decreased in four stages by $\Delta V$. Subsequently, back to FIG. 12, the flow proceeds to step S60 and the previously mentioned procedure is thereafter repeated.

When the pulse/dot ratio $\alpha$ decreases to the second ratio $\alpha 2$ due to the above described repetition, including the gradual decrease processing in the above described step S54, the condition of step S53 is satisfied (step S53: Yes), the flow returns to the above described step S60 of FIG. 12 as is, and the same procedure as described above is thereafter repeated. Note that the processing content of the CPU 74 that proceeds to the step S60 as is upon satisfaction of the condition of this step S53 is equivalent to the second control described in the claims.

On the other hand, after such a transition to the print length correction interval, if the print length correction interval ends and the pulse motor 63*a* is to return to the regular interval, the condition of step S52 is not satisfied (step S52: No), and the flow proceeds to step S55.

In step S55, the CPU 74 determines whether or not the pulse motor 63*a* is to return from the above described print length correction interval to the above described regular interval, based on the above described print data, similar to the above described step S110.

If the pulse motor 63*a* is to return to the regular interval, the condition of step S55 is satisfied (step S55: Yes) and the flow proceeds to step S56. If the pulse motor 63*a* is not to return to the regular interval, the condition of step S55 is not satisfied (step S55: No), the flow returns to the above described step S60 of FIG. 12 as is, and the same procedure as described above is thereafter repeated. Note that the processing content of the CPU 74 that proceeds to the step S60 as is without satisfaction of the condition of this step S55 is equivalent to the first control described in the claims.

In step S56, the CPU 74 determines whether or not the above described pulse/dot ratio $\alpha$ has reached the first ratio $\alpha 1$, which is a relatively large value corresponding to the previously mentioned regular interval.

Immediately after the pulse motor 63*a* starts to return from the print length correction interval to the regular interval, the pulse/dot ratio $\alpha$ has not reached the first ratio $\alpha 1$ and therefore the condition of step S56 is not satisfied (step S56: No) and the flow proceeds to step S57. In step S57, the CPU 74 increases the pulse/dot ratio $\alpha$ in an amount equivalent to the speed change $\Delta\alpha$, thereby gradually increasing the motor rotation speed. In the previously mentioned example, $\Delta V=|Va-Vb|/C$ (C: Number of stages=4) and the speed is gradually increased in four stages by $\Delta V$. Subsequently, back to FIG. 12, the flow proceeds to step S60 and the previously mentioned procedure is thereafter repeated. Note that the processing content of the CPU 74 in this step S57 and the previously mentioned step S54 is equivalent to the switching control described in the claims.

When the pulse/dot ratio $\alpha$ increases to the first ratio $\alpha 1$ due to the above described repetition, including the gradual increase processing in the above described step S57, the condition of step S56 is satisfied (step S56: Yes), the flow returns to the above described step S60 of FIG. 12 as is, and the same procedure as described above is thereafter repeated.

Note that the present disclosure is not limited to the above described embodiment, and various modifications may be made without deviating from the spirit and scope of the disclosure.

(1) if the Second Rotation Speed is Revised Downward and Extension of the Total Operation Time is Prevented That is, according to the above described embodiment, the pulse/dot ratio $\alpha$ gradually changes (rather than being immediately switched between $\alpha 1$ and $\alpha 2$) and the rotation speed of the pulse motor 63*a* is gradually decreased or gradually increased during the transition from the regular interval to the print length correction interval or during the transition from the print length correction interval to the regular interval. Nevertheless, as a result of performing such control, the overall total operation time when the mode is switched from the above described first coordinated state of the regular interval→the above described second coordinated state of the print length correction interval→the above described first coordinated state of the regular interval is extended compared to a case where the above are immediately switched (since the change in rotation speed of the pulse motor 63*a* slows down).

Figure 14:
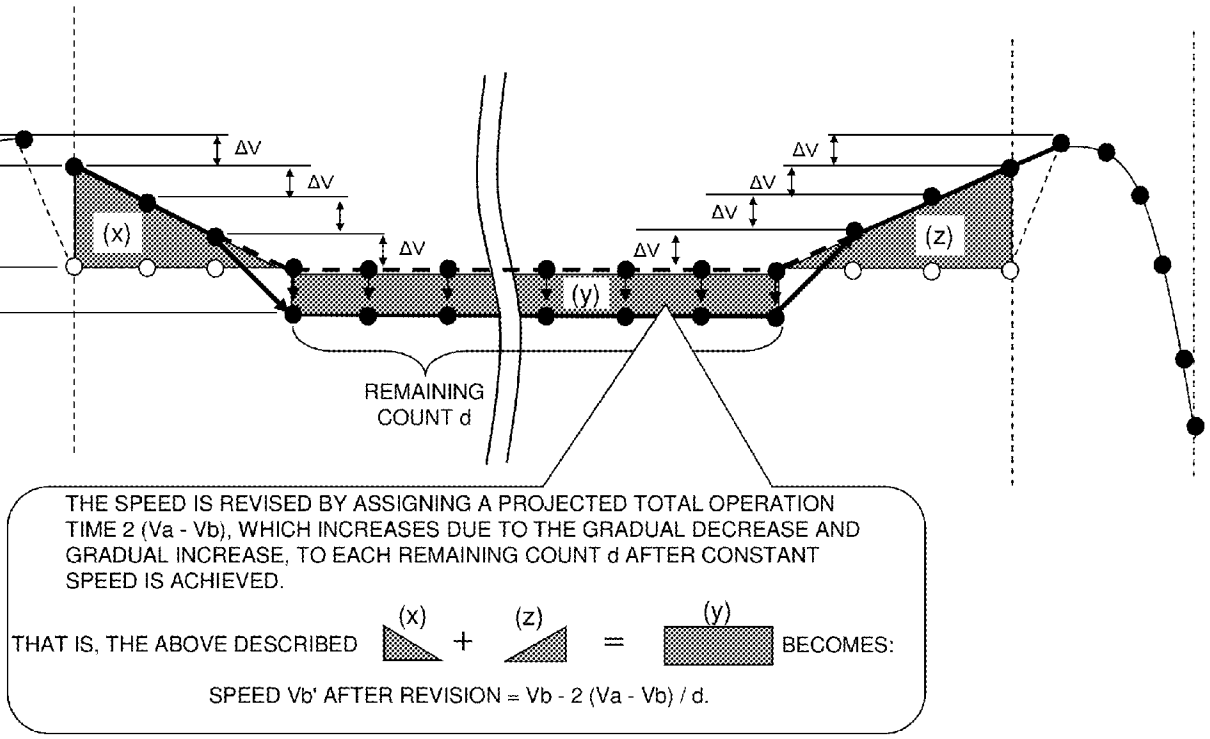
FIG. 14 is an explanatory view showing a specific example of the behavior of the rotation speed of the pulse motor in a modification where the rotation speed of the pulse motor in the print length correction interval is revised downward.

Hence, in this modification, as shown in FIG. 14, the above described second ratio $\alpha 2$ is corrected (to a smaller value than prior to correction, for example) so that the total operation time when the gradual decrease and gradual increase control of the rotation speed of the pulse motor 63*a* performed as described above is substantially the same as the total operation time when the above are immediately switched (without performing gradual decrease or gradual increase control).

That is, as shown in FIG. 14, a projected total operation time 2 (Va−Vb) which increases due to the gradual decrease and gradual increase in the above described technique is assigned to each remaining count d after constant speed is achieved (the second coordinated state), thereby revising the above described second rotation speed Vb downward to a lower speed Vb' (note that this revision processing content of the CPU 74 is equivalent to the correction processing described in the claims). As a result, the behavior of the rotation speed of the pulse motor 63*a* during the transition to the print length correction interval becomes a transition from a first stage decreasing speed (Va−ΔV)→a second stage decreasing speed (Va−2ΔV)→a third stage decreasing speed (Va−Δ3V)→a fourth stage decreasing speed, that is, the above described second rotation speed Vb' after revision (where Vb'<Vb; refer to the dashed arrow in FIG. 14). Similarly, the behavior of the rotation speed of the pulse motor 63*a* during return from the above described print length correction interval to the regular interval becomes a transition from the above described second rotation speed Vb' after revision→a first stage increasing speed (Vb+ΔV)→a second stage increasing speed (Vb+2ΔV)→a third stage increasing speed (Vb+Δ3V)→a fourth stage increasing speed (Vb+4ΔV; equivalent to Va; refer to the dashed arrow in FIG. 14).

Specifically, the above described speed Vb' after revision is determined so that the total surface area of a triangular region (x) from the previously mentioned first stage decreasing speed Va' (=Va−ΔV) to the rotation speed Vb' of the print length correction interval and a triangular region (z) from the rotation speed Vb' of the print length correction interval to the third stage increasing speed (equivalent to the above described Va' in this example) in FIG. 14 is equal to the surface area of the rectangular region (y) generated from the downward revision (from the rotation speed Vb prior to the above described revision) toward the above described rotation speed Vb' when the pulse motor 63*a* is constantly rotated in the above described print length correction interval. That is, the speed Vb' after revision is determined by the equation Vb'=Vb−4 (Va−Vb)/d. Hence, d is the number of pulses (pulse count) of the remaining intervals of the total number of pulses to be applied to the pulse motor 63*a* in the print length correction interval after subtracting the number of pulses (3+3=6 pulses in the above described example) used by the above described gradual decrease control and gradual increase control.

As a specific example, given Va=30, Vb=20, ΔV=2.5, and d=15, for example, then:

$$Vb' = 20 - 4(30-20)/15$$

$$= 20 - 2.666$$

$$= 17.334$$

(2) Other

Note that while the above has described an illustrative scenario in which the present disclosure is applied to a print label producing apparatus that performs desired printing on a print-receiving tape to produce a print label as the printer, the present disclosure is not limited thereto. That is, as printer examples, the present disclosure may be applied to a printer that forms an image and prints characters on regular print-receiving paper of a size such as A4, A3, B4, B5, or the like, or handheld printer driven by a battery power source. In this case as well, (if the model uses a pulse motor,) the same advantages are achieved.

Further, the arrows shown in the FIG. 6 denote an example of signal flow, but the signal flow direction is not limited thereto.

Also note that the present disclosure is not limited to the steps shown in the above described flow of the flowcharts of FIG. 12 and FIG. 13; step additions and deletions as well as sequence changes may be made without deviating from the spirit and scope of the disclosure.

Further, other than that already stated above, techniques based on the above described embodiment may be suitably utilized in combination as well.

What is claimed is:

1. A printer comprising:

a pulse motor configured to drive based on an inputting of a pulse signal;

a feeder configured to feed a print-receiving medium by using a driving force of said pulse motor;

a thermal head having a plurality of heating elements that is arranged in a direction orthogonal to a transport direction in which said print-receiving medium is fed by said feeder, the thermal head configured to at least form respective dots on respective printing lines, the respective printing lines formed by dividing said print-receiving medium in the transport direction in terms of a print resolution; and a controller configured to execute:

a first control that achieves a first coordinated state in which a pulse/dot ratio between a number of outputs of said pulse signal to said pulse motor and a number of prints of line print data that is formed by dividing print data per each of said printing lines when said pulse motor constantly rotates at a first rotation speed is set to a constant first ratio that is not 0, by means of controlling a conduction of said plurality of heating elements and a driving of said pulse motor in coordination;

a second control that achieves a second coordinated state in which said pulse/dot ratio when said pulse motor constantly rotates at a second rotation speed slower than said first rotation speed is set to a constant second ratio that is smaller than said first ratio and not 0, by means of controlling the conduction of said plurality of heating elements and the driving of said pulse motor in coordination; and a switching control that gradually decreases said pulse/dot ratio from said first ratio to said second ratio when said first coordinated state is switched to said second coordinated state, and gradually increases said pulse/dot ratio from said second ratio to said first ratio when said second coordinated state is switched to said first coordinated state, by means of controlling the conduction of said plurality of heating elements and the driving of said pulse motor in coordination.

2. The printer according to claim 1, wherein:

said controller further executes correction processing that corrects said second ratio of said second control so that a total operation time to return to said first coordinated state after switching from said first coordinated state to said second coordinated stated in a case where said gradual decrease of the switching control and said gradual increase of the switching control between said first ratio and said second ratio is performed by said switching control, is substantially the same as a total operation time to return to said first coordinated state after switching from said first coordinated state to said second coordinated stated in a case where switching is performed directly between said first ratio and said second ratio without performing said gradual decrease of the switching control and said gradual increase of the switching control; and said switching control gradually decreases said pulse/dot ratio from said first ratio to said second ratio after correction by said correction processing when said first coordinated state is switched to said second coordinated state, and gradually increases said pulse/dot ratio from said second ratio after the correction to said first ratio when said second coordinated state is switched to said first coordinated state.

3. The printer according to claim 1, wherein:

said controller further executes a third control that accelerates a speed of said pulse motor from a stopped state to said first rotation speed and sets a speed of said pulse motor from said first rotation speed to the stopped state while setting said pulse/dot ratio to said first ratio, by means of controlling the conduction of said plurality of heating elements and the driving of said pulse motor in coordination.

* * * * *